US005516057A

United States Patent [19]

Menegatto

[11] Patent Number: 5,516,057

[45] Date of Patent: May 14, 1996

[54] DEVICE FOR REGULATING THE TAPERING OF THE SIDES OF TEXTILE PACKAGES

[75] Inventor: Carlo Menegatto, Milan, Italy

[73] Assignee: Menegatto S.r.l., Milan, Italy

[21] Appl. No.: 275,402

[22] Filed: Jul. 15, 1994

[30] Foreign Application Priority Data

Jul. 23, 1993 [IT] Italy ..... MI93A001642

[51] Int. Cl.[6] ..... B65H 54/28

[52] U.S. Cl. ..... 242/43.1; 242/158 R; 242/158.1; 242/158.5

[58] Field of Search ..... 242/43.1, 43 R, 242/158.5, 158 R, 158.1

[56] References Cited

U.S. PATENT DOCUMENTS

| | | | |
|---|---|---|---|
| 3,904,140 | 9/1975 | Hermanns | 242/43.1 |
| 4,555,069 | 11/1985 | Maeda et al. | 242/43.1 X |

FOREIGN PATENT DOCUMENTS

| | | | |
|---|---|---|---|
| 1116662 | 5/1956 | France | 242/43.1 |
| 1379004 | 10/1964 | France | 242/43.1 |
| 2255065 | 3/1977 | Germany . | |
| 3732575 | 3/1989 | Germany . | |
| 47-48820 | 8/1972 | Japan | 242/43.1 |
| 78957 | 5/1983 | Japan | 242/158 R |
| 523842 | 7/1972 | Switzerland . | |

*Primary Examiner*—William Stryjewski
*Attorney, Agent, or Firm*—Young & Thompson

[57] ABSTRACT

A device regulates the tapering of at least one side edge of a package of yarn on a spool in a textile winding apparatus, wherein a reciprocating yarn guide member distributes yarn onto a rotating spool. The device includes a cam having at least a first and a second cam contour, each for driving a respective tapering of the one side edge of the package of yarn and a transmission having an element sliding on the cam for operatively connecting the cam to the yarn guide member. The first and second cam contours are arranged parallel to each other, while the sliding element of the transmission is movable perpendicularly to the first and second contours. Also, there is a device provided for positioning the sliding element of the transmission on a selected contour of the cam contours.

13 Claims, 3 Drawing Sheets

DEVICE FOR REGULATING THE TAPERING OF THE SIDES OF TEXTILE PACKAGES

BACKGROUND OF THE INVENTION

1. Field of the Invention

The present invention relates to a device for regulation of the tapering of the side edges of a package of yarn in a textile winding apparatus, wherein a pakcage of yarn is provided on a spool, making the latter to rotate around its own longitudinal axis, while at least a yarn guide member, moving reciprocally and parallel to said longitudinal axis of the spool, distributes said yarn onto the spool itself.

2. Description of the Related Art

In winding apparatus knon hitherto, the tapering of the side edges of the package of yarn, in other words the conicity of said side edges, is achieved by gradually shortening the stroke of the yarn guide member as the deposit of yarn on the spool increases.

Currently, this variation in the stroke of the yarn guide members can be obtained by using a single cam contour attached to the axis of the spool-holder arm which, via a suitable transmission mechanism, drives the variation of the stroke of the yarn guide members. With this known device, when it is necessary to vary the profile of the side edge of the package of yarn, the cam for driving the stroke of the yarn guide member has to be replaced. It is therefore necessary to stop the machine and replace said cam with another cam having a more suitable contour for the type of work in progress. This changeover obviously involves costs, both due to the use of labour to perform said operation of replacing the cam, and due to the nonproduction caused by the down time of the machine for performing the change of the cam.

Some manufacturers have decided to solve the previous problem by setting up a cam having different contours for different taperings of the side edges of the package of yarn. Said contours are formed in a series along the same circumferential line of the cam, i.e. on the edge of a same discoidal element forming the cam. The median lines of all said contours of the cam lie on the same plane. In this way the operation of removing and replacing the drive cam contour is made easier. In fact it is sufficient to rotate the discoidal element and place the required cam contour in the working position. However, the use of this type of drive cam has disadvantages; it is in fact necessary in this case also to disengage the discoidal element which holds the cam contours from the spool-holder arm to make it rotate, position and re-engage it in the required working position. These operations also require a certain working time by stagg and the machine has to be stopped.

Moreover this cam element is limited in the number of cam contours which it can hold or in the angle of rotation which these contours can achieve. In fact, if for example four cam contours are used, each of these can at most rotate through ninety degrees.

SUMMARY OF THE INVENTION

The object of the present invention is therefore that of providing a device for the regulation of the tapering of the side edges of textile package of a yarn wherein the type of tapering cna be varied easily and rapidly without having to resort the stopping the textile machine.

Another object of the present invention is that of providing a device of the type referred to above, wherein it is also possible to obtain cam contours for driving tapering of the edges which have as wide a rotation angle as required.

The previous objects are achieved with a device for regulating the tapering of at least one edge of a package of yarn on a spool in a winding apparatus, wherein a spool-holder arm is supported rotatably by the frame of said winding apparatus and is driven to rotate when the thickness of the package of yarn on said spool increases, and wherein the spool supporting the package of yarn is made to rotate around its own longitudinal axis, while a yarn guide member moves reciprocally and parallel to said longitudinal axis of said spool for distributing said yarn onto said spool; the device for regulation of the tapering of said side edges comprising cam means for driving the variation of the stroke of said yarn guide member in order to regulate the tapering of said edge of the package, which cam means are connected with said spool-holder arm for rotating therewith, transmission means for operatively connecting said cam means to said yarn guide member for driving the variation of the stroke of said yarn guide member, said transmission means having a sliding element sliding on said cam means when sid cam means rotates with said spool-holder arm, said cam means comprise at least first and second cam contours each for driving a respective tapering of the lateral edge of said package of yarn; in which said first and second cam contours are arranged parallel to each other, in which said sliding element of said transmission means is mobile crosswise to said first and second cam contours, and in which means are provided for positioning said sliding element of said transmission means on a selected contour of said cam contours.

According to the device of the present invention the displacement of the sliding element from one cam contour to another is easily performed by moving crosswise the sliding element and positioning it on the selected cam contour.

The above-described operations can be performed easily and rapidly without any disassembly and replacement of elements being required and can also be performed with the textile machine in operation without having to stop the production process at all.

BRIEF DESCRIPTION OF THE DRAWINGS

Further features and advantages will be made clearer on reading the description which follows with reference to the accompanying drawings in which.

In the figures which follow, the same elements bear the same reference numerals to facilitate description.

DESCRIPTION OF THE PREFERRED EMBODIMENT

Figure 1:
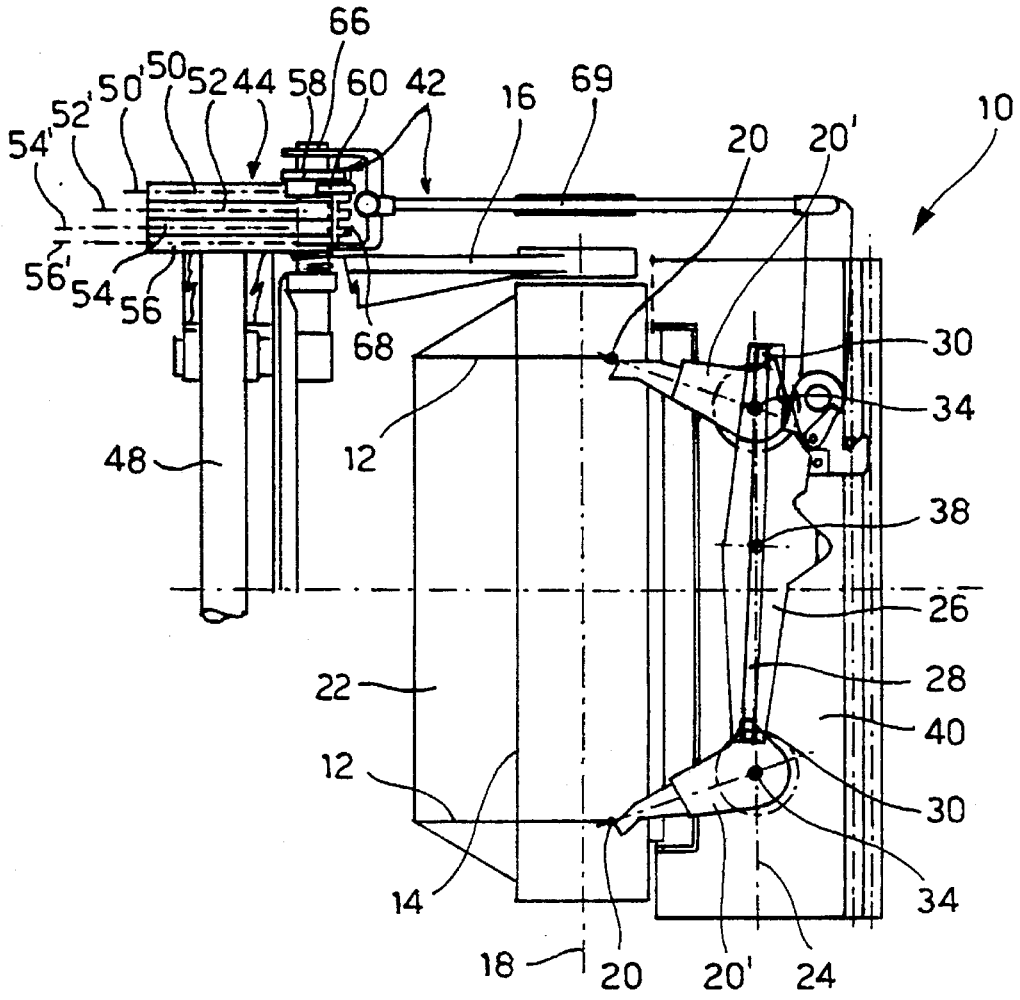
FIG. 1 is a plan view from above of the device for regulation of the tapering of the side edges of the package of yarn according to the invention.

FIG. 1 shows an apparatus 10 for winding yarn 12 onto a spool 14. In it the spool 14, supported by a suitable spool-holder arm 16, is made to rotate around its own longitudinal axis 18, while the yarn guide members 20, 20 are moved reciprocally and parallel to said longitudinal axis 18 of the spool 14 to distribute the yarn 12 onto the same spool 14 for providing a package of yarn 22.

The yarn guide members 20, 20 are moved reciprocally along a path 24 marked by the dotted lines and dots in FIG. 1, driven by suitable means (not shown), which can be a bar in reciprocal motion whereto they are firmly attached, or the cam of a drum moved to rotate within which said yarn guide is made to slide so as to describe the abovementioned rectilinear and reciprocal motion.

Said yarn guide members 20, 20 are supported on one end or tip of respective yarn guide support elements 20', 20'.

The variation in the stroke of these yarn guide members, 20, 20, which enables the side edges of the package of yarn 22 to be shaped as required, is driven by cam means 44 by suitable transmission means.

Said transmission means comprise a rocking lever 26 for regulating the stroke of the yarn guide members 20, 20.

This regulation rocking lever 26 has a hollow guideway 28 wherein sliders 30, 30 of the yarn guide support elements 20', 20' are free to slide, while the yarn guide support elements 20', 20' are driven in reciprocal motion along said path 24 by means of respective pins 34, 34.

The rocking lever 26 for regulating the stroke of the yarn guide members 20, 20 rocks about hinge 38 connected to frame 40 of the winding apparatus and is made to rotate so that, by moving the sliders 30, 30, the yarn guide support elements 20', 20' tilt, causing the required displacement of their tips and of the yarn guide members 20, 20 which are attached thereto.

Said transmission means further comprise a lever mechanism 42 co-operating with said cam means 44 to cause the rotation or oscillation of the rocking lever 26 for regulating the stroke of the yarn guide members 20, 20.

Figure 2:
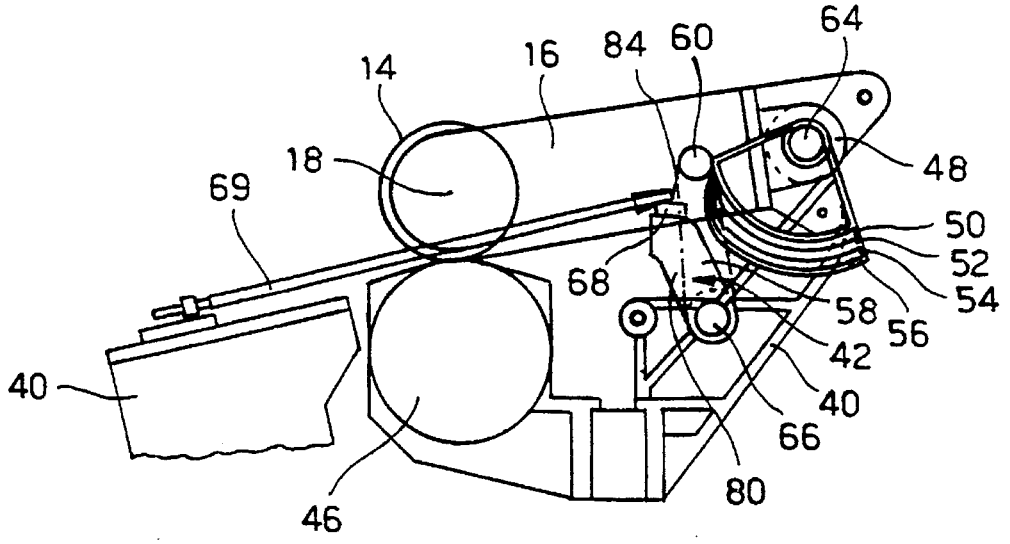
FIG. 2 is a side view of the device of the invention showing a condition of empty spool.
Figure 3:
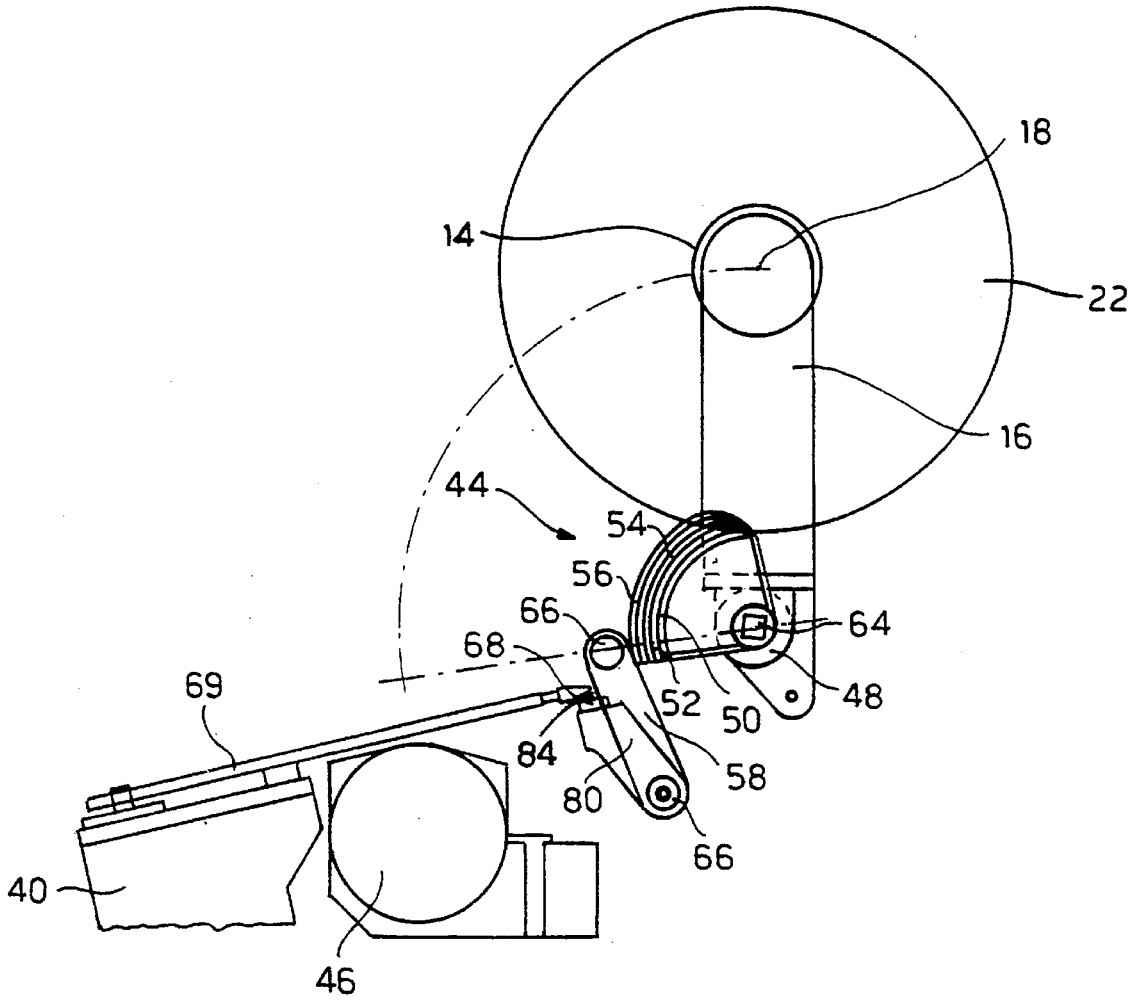
FIG. 3 is a side view of the device of the invention similar to that of FIG. 2, showing the condition of transfer of the spool by the device of the invention.

As shown better in the subsequent FIGS. 2 and 3, as the deposit or thickness of the package of yarn 22 on the spool 14 increases, the spool-holder arm 16 rises, forced by the spool 14 on the roller 46 for driving the spool 14 itself to rotate.

Said cam means 44 are fastened to a support axis 48 of said spool-holder arm 16 drives the cam means 44 attached thereto to rotate.

Figure 5:
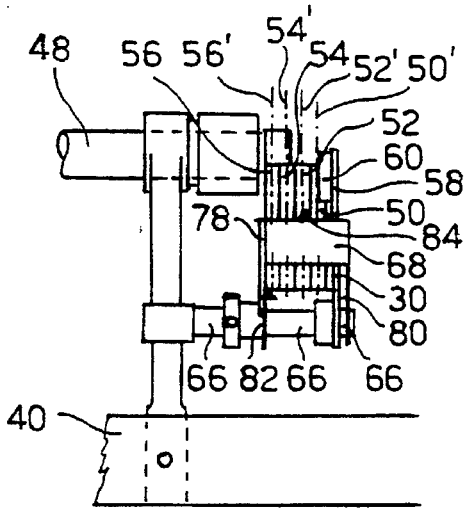
FIG. 5 is a front view of a detail relating to the system for driving regulations of the side edges according to the present invention.
Figure 4:
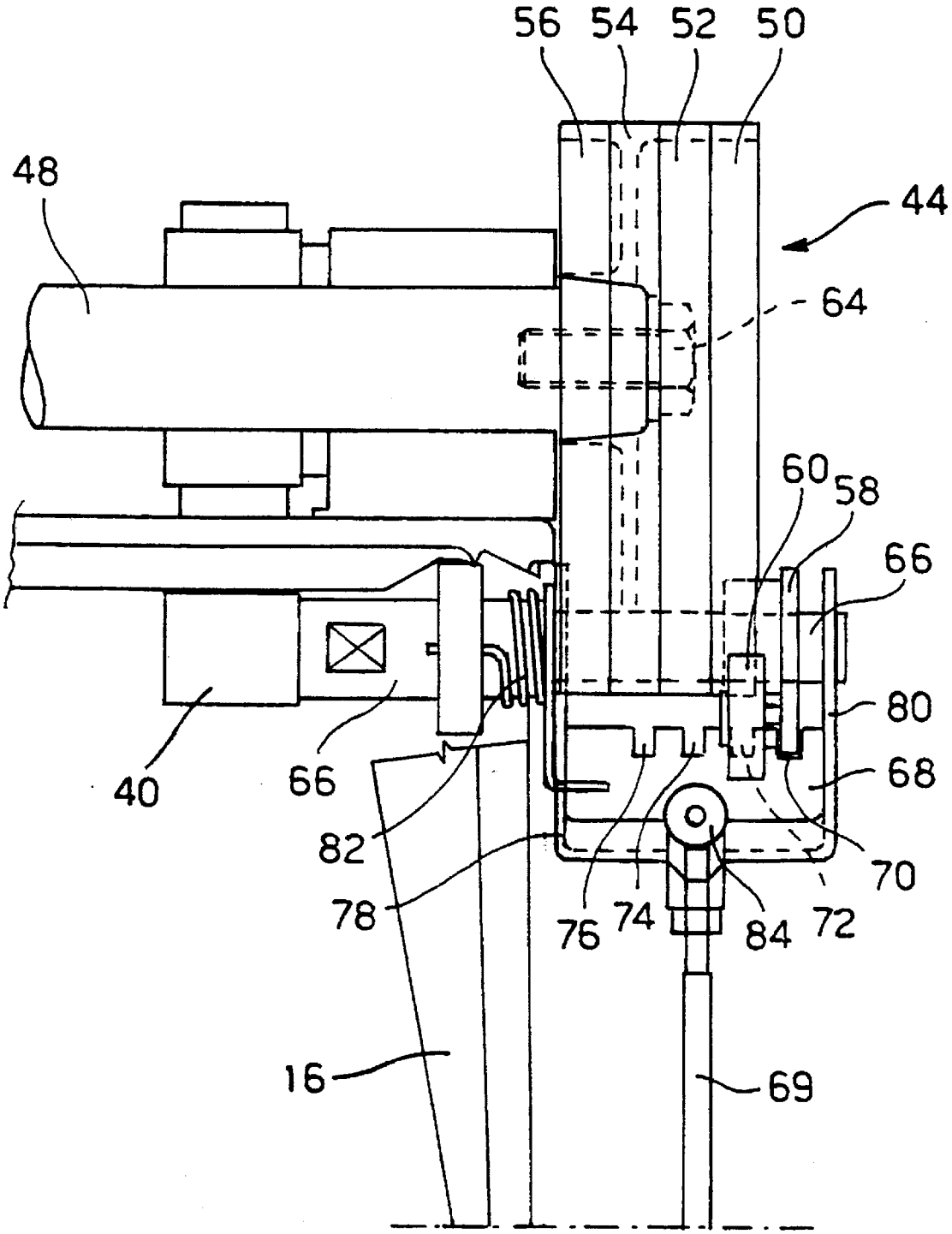
FIG. 4 is a plan view from above of a significant detail of the regulation device.

Said cam means 44, which may be understood better by taking into account the subsequent FIGS. 4 and 5, according to the present embodiment comprise a first, a second, a third and a fourth can contour 50, 52, 54 and 56 respectively, which according to the invention are arranged parallel to each other.

In the preferred embodiment of the invention said cam contours 50, 52, 52 and 56 are placed side by side; however cam contours spaced apart one from the other are conceivable for the present invention.

In the figures, there are shown the median lines 50', 52', 54', 56' of said cam contours 50, 52, 54, 56 respectively. These mediam lines 50', 52', 54', 56' lie on parallel planes and are distances one from the other.

Advantageously, said cam contours 50, 52, 54, 56 are formed on the outer edge of an element having a general circular segment shape which is attached to the support axis 48 of the spool-holder arm 16 by means of a suitable fastening screw 64 which screws into a corresponding threaded hole formed in the end face of the support axis 48. By disengaging the fastening screw 64 it is possible to remove and replace rapidly the used cam system 44 with another more suitable for the type of processing.

The lever mechanism 42 of said transmission means comprises an arm member 58 which at one of its ends holds a rotatable roller 60 for sliding on the selected cam contour, the arm member 58 is in turn at the other lower end hinged to a guide shaft 66 to move from and towards said cam contours 50, 52, 54, 56 rotating in a plane transversal to said guide shaft 66. Said shaft 66 is attached to the frame 40 of the winding apparatus, arranged underneath and in front to said cam means 44, and extends crosswise to said cam contours 50, 52, 54, 56. The arm member 58 can slide on this small shaft 66 so as to move crosswise to said cam contours 50, 52, 54, 56, i.e. transversal to the median lines 50', 52', 54' 56' of the cam contours 50, 52, 54, 56, and be able to move the roller 60 from one cam contour to another.

The driving lever mechanism 42 of the transmission means moreover comprises, according to the invention, means for positioning the roller 60 on the required cam contour. These means comprise an elongated positioning member 68, also arranged crosswise to said cam contours, and placed in fromt to said cam means upper and parallel to said guide shaft 66.

Said positioning 68 has positioning elements, each for positioning the slidable element60 on a respective cam contour. In the present preferred embodiment of FIG. 4, the positioning elements are slots 70, 72, 74, 76 for insertion of the roller-holder arm member 58.

Said slots 70, 72, 74, 76, fully visible in FIG. 4, are arranged on the side of the elongated arm member 58 which is turned towards said cam contours 50, 52, 54, 56 and are spaced apart to each other in the direction crosswise to said cam contours in such a position as to enable, when the mobile arm member 58 is inserted therein, the correct sliding of the roller 60 on a corresponding cam contour.

The positioning member 68 is attached to the guide shaft 66 by means of two side uprights 78, 80 each connected to a respective end of said guide shaft 66 for rotating in a plane transversal to said guide shaft 66. The positioning member 68 is pushed against the arm member 58, for maintaining the roller 60 in close contact with the cam contour whereon it slides, by a preloaded torsional spring 82 which is arranged between the small shaft 66 and the upright 78 supporting the positioning member 68.

The roller-holder arm member 58 slides on the guide shaft 66 defined in its stroke by the side uprights 78 and 80 which define end stop means for the stroke of said roller-holder arm member 58.

The lever mechanism 42 for driving oscillation of the regulation rocking lever 26 comprises a rod 69 which is operatively connected at one of its ends to said regulation rocking lever 26 and at the other end is connected by a spherical hinger 84, placed above said positioning member 68 to the same elongated positioning member 68'.

According to the invention the displacement of the roller 60 from one cam contour to the other is easily performed by pulling the positioning member 68 is an opposite direction to the action of the spring 82, and by removing the mobile roller-holder arm member 58 from the slot wherein it is inserted to insert it in another slot corresponding to a selected cam contour.

The release of the positioning member 68 brings the latter, through the effect of the thrust of the spring 82, to push against the roller-holder arm member 58 so as to engage the roller 60 on the required cam contour.

The above-described operations can be performed easily and rapidly without any disassembly and replacement of elements being required and can also be performed with the machine 10 in operation without having to stop the production process at all.

With the device of the present invention the spool-holder arm 16 can be piloted advantageously for an angle of rotation which is as large as required, if necessary enabling overturning of the position of the arm 16 or in any case positioning of the spool 14 in any required position whatsoever for transfer of the same, as showed in FIG. 3.

What is claimed is:

1. A device for regulating a tapering of at least one side edge of a package of yarn on a spool in a winding apparatus, wherein a spool-holder arm is supported rotatably by a frame of said winding apparatus and is driven to rotate when a thickness of the package of yarn on said spool increases, and wherein the spool supporting the package of yarn is made to rotate around its own longitudinal axis while a yarn guide member moves reciprocally and parallel to said longitudinal axis of said spool for distributing said yarn onto said spool; said device for regulating the tapering of said at least one side edge comprising:

cam means for driving a variation of a stroke of said yarn guide member in order to regulate the tapering of said at least one side edge of the package, which said cam means are connected with said spool-holder arm for rotating therewith;

transmission means for operatively connecting said cam means to said yarn guide member for driving the variation of the stroke of said yarn guide member, said transmission means having an element sliding on said cam means when said cam means rotates with said spool-holder arm;

said cam means including at least a first and a second cam contour, each for driving a respective different tapering of the at least one side edge of said package of yarn;

said first and second cam contours being arranged parallel to each other, in which said sliding element of said transmission means is mobile perpendicularly to said first and second cam contours; and means for positiioning said sliding element of said transmission means on a selected contour of said cam contours.

2. A device according to claim 1, in which said cam means further include a third and a fourth cam contour arranged parallel to each other and to said first and second cam contours.

3. A device according to claim 2, in which said cam contours are placed side by side.

4. A device according to claim 3, in which said cam contours are integral one with the other and attached to sid spool-holder arm by disengageable fastening means.

5. A device according to claim 1, in which said sliding element of said transmission means is supported by an arm member of said transmission means, said arm member being freely movable perpendicular to said cam contours.

6. A device according to claim 5, in which said arm member is supported and slidable along a guide shaft fixedly connected to the frame of the winding apparatus and is arranged perpendicularly to said cam contours, said arm member being articulated to said guide shaft to move said sliding element away from and towards said cam contours in a plane transversal to said guide shaft.

7. A device according to claim 6, in which said means for positioning said sliding element on the selected cam contour of said cam contours include an elongated positioning member arranged perpendicularly to said cam contours, said elongated positioning member having elements for positioning said slidable element on the selected cam contour of said cam contours.

8. A device according to claim 7, in which said positioning elements are slots provided in the elongated positioning member.

9. A device according to claim 8, in which said arm member is situated between said elongated positioning member and said cam contours, in which said slots are formed on a side of said elongated positioning member which is turned towards said cam contours for insertion of said arm member, and in which said slots are spaced apart from each other in a direction perpendicular to said cam contours so that when the arm member is inserted in each of said slots said sliding element is positioned on a corresponding selected cam contour of said cam contours.

10. A device according to claim 9, in which elastic thrust means are provided to engage said elongated positioning member against said arm member and push said sliding element towards and against the selected cam contour of said cam contours.

11. A device according to claim 10, in which said elongated positioning member is supported by said guide shaft for guiding the arm member between two side uprights each connected to a respective end of said guide shaft for rotating in a plane transversal to said guide shaft, and in which said arm member is arranged and slides internally between said two side uprights which provide end stops for a stroke of the arm member.

12. A device according to claim 11, in which said elastic thrust means are arranged between one of said two side uprights and said guide shaft for guiding the stroke of the arm member therebetween.

13. A device according to claim 7, in which said transmission means for driving the variation of the stroke of said yarn guide member include a rod having one end connected to said elongated positioning member which is a part of the transmission means.

* * * * *